US011421429B1

(12) United States Patent
Elzner et al.

(10) Patent No.: US 11,421,429 B1
(45) Date of Patent: Aug. 23, 2022

(54) METHOD OF ATTACHING MOLDING, TRIM OR PANELS TO STRUCTURES

(71) Applicants: Robert Dean Elzner, Pocatello, ID (US); Jason Woodland, Pocatello, ID (US)

(72) Inventors: Robert Dean Elzner, Pocatello, ID (US); Jason Woodland, Pocatello, ID (US)

( * ) Notice: Subject to any disclaimer, the term of this patent is extended or adjusted under 35 U.S.C. 154(b) by 35 days.

(21) Appl. No.: 16/513,248

(22) Filed: Jul. 16, 2019

Related U.S. Application Data

(60) Provisional application No. 62/698,732, filed on Jul. 16, 2018.

(51) Int. Cl.

| | |
|---|---|
| ***E04F 19/02*** | (2006.01) |
| ***E04F 13/08*** | (2006.01) |
| ***G09F 7/00*** | (2006.01) |
| ***E04F 19/06*** | (2006.01) |

(52) U.S. Cl.
CPC ..... *E04F 19/02* (2013.01); *E04F 13/0803* (2013.01); *E04F 13/0894* (2013.01); *E04F 19/06* (2013.01); *G09F 7/00* (2013.01)

(58) Field of Classification Search
CPC ..... E04F 13/24; E04F 13/0889; E04F 13/08; E04F 13/07; E04F 13/0871; E04F 13/0875; E04F 13/0894; E04F 2201/023; E04F 13/083; E04F 13/088; E04F 13/0851; B32B 5/18
See application file for complete search history.

(56) References Cited

U.S. PATENT DOCUMENTS

| | | | | |
|---|---|---|---|---|
| 4,555,432 A * | 11/1985 | Bossons | ..... | E04F 13/0851 248/496 |
| 5,179,811 A | 1/1993 | Walker | | |
| 5,359,817 A | 11/1994 | Fulton | | |
| 5,819,485 A | 10/1998 | Lane | | |
| 6,134,846 A * | 10/2000 | Lamb | ..... | A47F 5/0846 211/94.01 |

(Continued)

FOREIGN PATENT DOCUMENTS

| | | |
|---|---|---|
| CA | 2254751 A1 | 7/1999 |
| KR | 100817912 B1 | 3/2008 |

(Continued)

*Primary Examiner* — Gisele D Ford
(74) *Attorney, Agent, or Firm* — Adam D. Stevens; Kirton McConkie

(57) ABSTRACT

A panel mounting system for mounting building materials to a building surface includes a rigid cleat fixed with the building surface. Multiple building panels each have a cleat depression formed in a rear surface for receiving the cleat. Each edge of the building panel interlocks with an adjacent panel so that all of the building panels hold each other together against the building surface along with the cleat. Some of the building panels may include a hooked flange projecting that engages a flange-receiving groove of an adjacent building panel to mutually secure the building panels together. Some embodiments include a gable rail fixed with the building surface that projecting outwardly to engage a gable rail-receiving slot formed within the rear surface of a trim panel that has an ornate front surface. Other decorative panels may be included for fixing with the trim panels or other of the bundling panels.

13 Claims, 5 Drawing Sheets

(56) References Cited

U.S. PATENT DOCUMENTS 6,393,779 B1 * 5/2002 Boldt ..... E06B 1/10 52/204.1
6,504,098 B2 1/2003 Seamans
6,560,944 B1 5/2003 Wilson
6,643,987 B2 11/2003 Rusch
7,603,824 B1 10/2009 Hartanto
8,220,648 B2 * 7/2012 Barkdoll ..... A47F 5/0846 211/94.01
8,763,312 B2 * 7/2014 Carter ..... E04B 2/46 52/36.5
8,813,623 B2 8/2014 Armacost
9,260,871 B2 2/2016 Shaw
9,534,402 B2 1/2017 Shaw
9,580,918 B2 2/2017 Armacost
9,611,659 B2 4/2017 Baert
9,611,661 B2 4/2017 Armacost
9,945,131 B2 4/2018 Gosling
2004/0211144 A1 10/2004 Stanchfield
2005/0144881 A1 7/2005 Tate
2005/0284072 A1 * 12/2005 Andres ..... E04B 5/12 52/578
2006/0185299 A1 8/2006 Poupart
2007/0017174 A1 1/2007 Lavell
2007/0039257 A1 2/2007 LeBlanc
2008/0034688 A1 2/2008 Neuhofer, Jr.
2009/0013636 A1 1/2009 Wilson
2009/0071089 A1 * 3/2009 Neuhofer, Jr. ..... E04F 11/166 52/469
2009/0094925 A1 * 4/2009 Andres ..... E04F 15/04 52/511
2009/0151134 A1 6/2009 Neuhofer
2010/0018145 A1 1/2010 Ellis
2010/0242389 A1 9/2010 DePaul
2010/0281798 A1 11/2010 Sondermann
2010/0319293 A1 * 12/2010 Dammers ..... E04F 15/02 52/588.1
2011/0179733 A1 7/2011 Picken
2012/0151850 A1 * 6/2012 Cashman ..... E04F 19/064 52/36.3
2013/0047532 A1 * 2/2013 Armacost ..... E04F 21/0069 52/288.1
2013/0084413 A1 * 4/2013 McMahan ..... A47G 27/0231 428/33
2013/0091791 A1 4/2013 Hardy
2014/0093677 A1 * 4/2014 Permesang ..... E04F 15/02038 428/99
2015/0040510 A1 2/2015 Shaw
2015/0059271 A1 * 3/2015 Tsai ..... E04F 15/02044 52/302.1
2015/0197979 A1 7/2015 Hawk
2016/0115696 A1 4/2016 Shaw
2017/0145700 A1 5/2017 Armacost
2018/0030739 A1 2/2018 Meske
2018/0334809 A1 * 11/2018 Smart ..... E04F 13/0846

FOREIGN PATENT DOCUMENTS

KR 20080113897 A 12/2008
KR 101011782 B1 2/2011
KR 20120027811 A 3/2012
KR 20130019948 A 2/2013
KR 20130043354 A 4/2013

* cited by examiner

METHOD OF ATTACHING MOLDING, TRIM OR PANELS TO STRUCTURES

CROSS-REFERENCE TO RELATED APPLICATIONS

This application claims the benefit of U.S. Provisional Patent Application 62/698,732, filed on Jul. 16, 2018, and incorporated herein by reference.

STATEMENT REGARDING FEDERALLY SPONSORED RESEARCH AND DEVELOPMENT

Not Applicable.

FIELD OF THE INVENTION

This invention relates to panel mounting, and more particularly to an improved system for mounting panels, molding, or trim to structures.

DISCUSSION OF RELATED ART

Applying stucco or other building materials to a building surface requires multiple steps and requires significant equipment and manpower at the jobsite. Obtaining a consistent looks on a building in areas where two different contractors work is also often a challenge due to varying skill levels or styles different people. These drawbacks of convention building finishes result in higher costs and longer build times.

Therefore, there is a need for a system that allows for consistent prefabricated building panels to be applied to the building surface quickly and without requiring use of extensive equipment at the jobsite. Such a system would allow for the efficient covering of various types of building surfaces and provide a consistent look around windows, door frames, trim areas, vents, vertical columns, and of course large sides of buildings. The present invention accomplishes these objectives.

SUMMARY OF THE INVENTION

The present device is a panel mounting system for mounting building materials to a building surface. Such building materials may take the form of vinyl siding, rock, sand, brick, cement, plaster, stucco, wood, bark, plastic, or the like.

A rigid cleat, preferable made with sheet metal or other rigid material, is fixed with the building surface, such as with mechanical fasteners such as screws, nails or the like. The rigid cleat has at least one extending lip.

A plurality of building panels each preferably has a front surface, a rear surface, a top edge, a bottom edge, a left edge, and a right edge. Each building panel preferably has a cleat depression formed in the rear surface parallel to the bottom edge thereof. The cleat depression has at least one cleat lip resilient deforming and then extending over the cleat depression when becoming fully engaged with the rigid cleat. The building panel is held by the rigid cleat against the building surface. The front surface is adapted for receiving at least partially thereon a coating of the building materials.

The bottom edge of each building panel preferably has an interlocking fit with the top edge of another of the building panels. Similarly, the left edge of each building panel has an interlocking fit with the right edge of another of the building panels. As such, all of the building panels hold each other together against the building surface. The interlocking fit may be a tongue-in-groove type interlocking fit, for example.

Some of the building panels may include a hooked flange projecting away from the front surface proximate the bottom edge thereof. A flange-receiving groove projects away from the front surface of such building panels proximate the top edge thereof. The flange-receiving groove of adjacent building panels cooperate with the hooked flange of another of the building panels to mutually secure the building panels together. P Some embodiments include a gable rail fixed with the building surface that projecting outwardly from the building surface. Corresponding building panels further includes a gable rail-receiving slot formed within the rear surface thereof that is adapted to receive the gable rail to hold the building panel to the building surface. Such a gable rail may include a J-shaped portion at a distal end thereof, such that when inserted into the gable rail-receiving slot of the building panel, the J-shaped portion flexes to catch or bind the gable rail-receiving slot of the building panel to inhibit removal thereof from the building surface.

Some of the building panels take the form of a trim panel that has an ornate front surface. The rear surface of such trim panels include one of the gable rail-receiving slots formed therein for mounting with the gable rail fixed with the building surface.

A keystone cover may be included that has a decorative front surface and a rear side shaped to engage the ornate front surface of the trim panel for fixing thereto with one of the mechanical fasteners, adhesive, or the like. The keystone cover is preferably also coated with the building materials and is made of expanded polystyrene.

The present invention is a system that allows for a consistent prefabricated panel to be applied to the building surface quickly and without requiring use of extensive equipment at a jobsite. Such a system would allow for the efficient covering of various types of building surfaces and provide a consistent look around windows, door frames, trim areas, vents, vertical columns, and the sides of buildings. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1 and 3-5 illustrate a panel mounting system 10 for mounting building materials 20 to a building surface 15. Such building materials 20 may take the form of vinyl siding, rock, sand, brick, cement, plaster, stucco, wood, bark, plastic, closed-cell foam, or the like.

Figure 6:
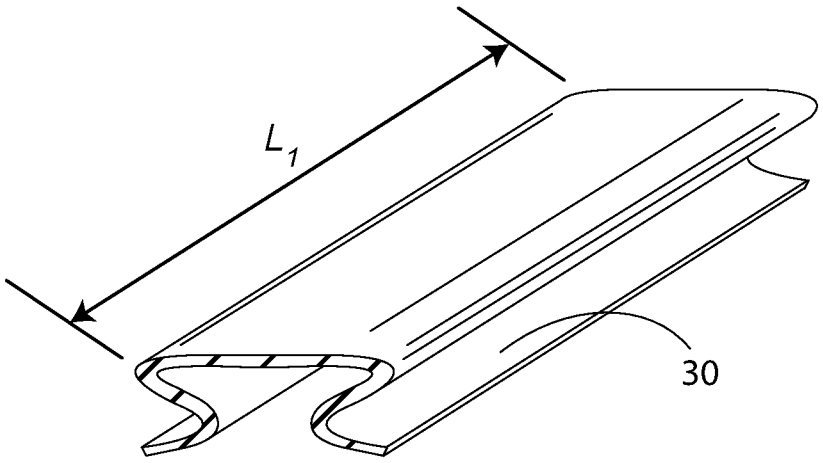
FIG. 6 is a perspective view of a rigid cleat of the invention.

A rigid cleat 30, preferable made with sheet metal or other rigid material, is fixed with the building surface 15, such as with mechanical fasteners 120 such as screws, nails or the like. The rigid cleat 30 has at least one extending lip 38 and has a length $L_1$ (FIG. 6) of preferably between two feet to ten feet.

A plurality of building panels 40 each preferably has a front surface 42, a rear surface 48, a top edge 41, a bottom edge 49, a left edge 44, and a right edge 46. Each building panel 40 preferably has a cleat depression 50 formed in the rear surface 48 parallel to the bottom edge 49 thereof. The cleat depression 50 has at least one cleat lip 55 resilient deforming and then extending over the cleat depression 50 when becoming fully engaged with the rigid cleat 30. The building panel 40 is held by the rigid cleat 30 against the building surface 15, and is preferably a expanded polystyrene type foam material. The front surface 42 is adapted for receiving at least partially thereon the building materials 20, such as a coating of vinyl, rock, sand, brick, cement, plaster, stucco, wood, bark, plastic, or the like. Each building panel 40 is preferably made with expanded polystyrene, or a like light-weight material.

Figure 3:
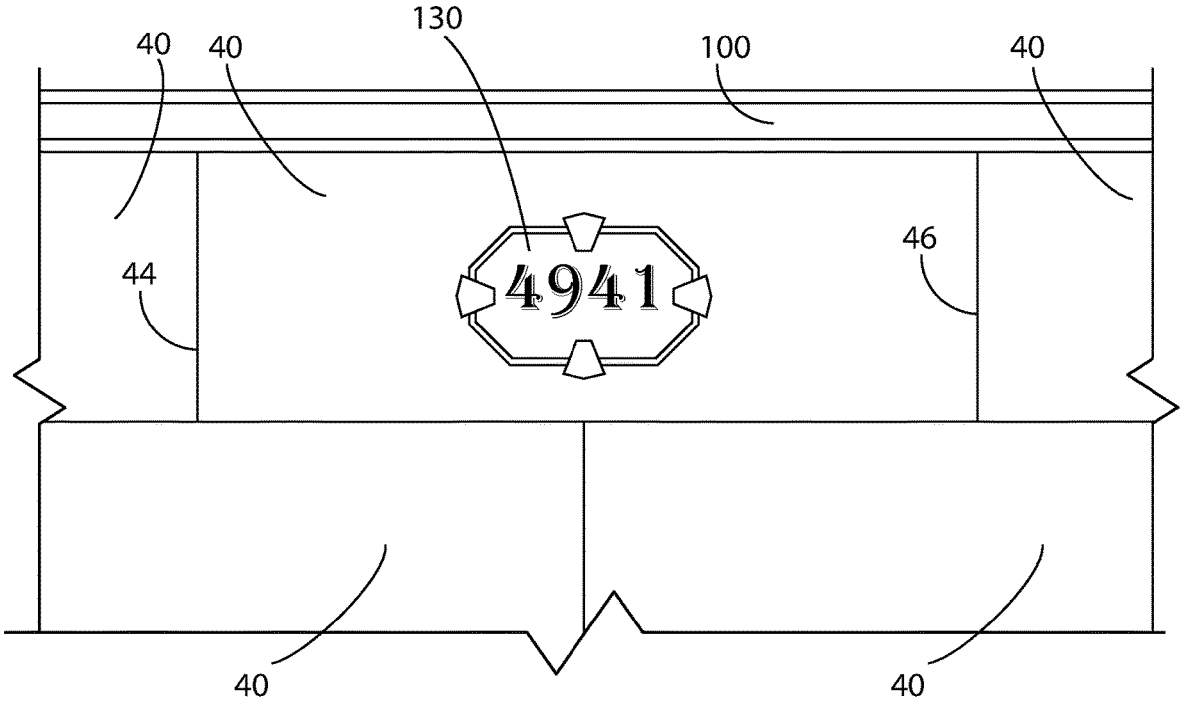
FIG. 3 is a front elevational view of the invention, illustrating an address plaque panel of the invention.
Figure 4:
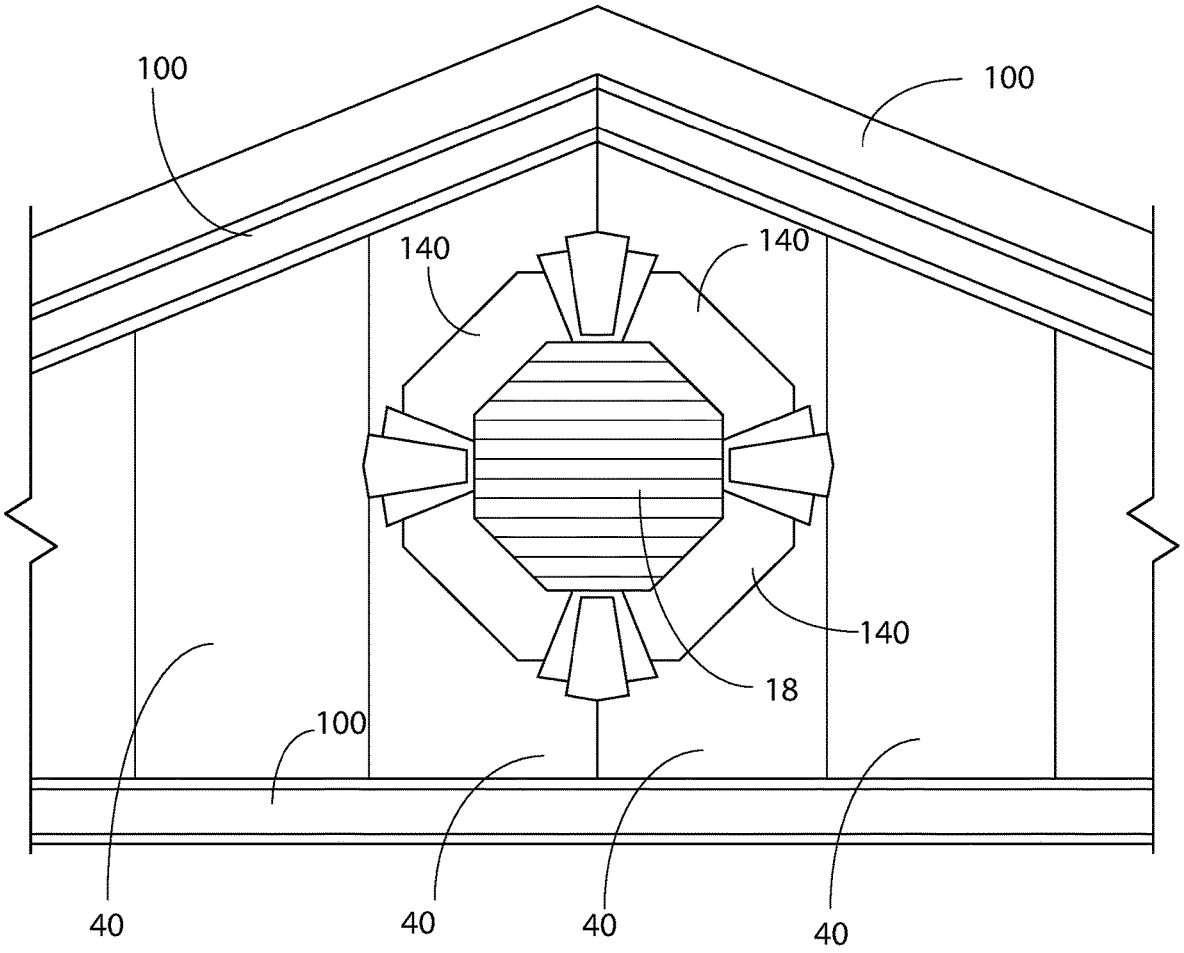
FIG. 4 is a front elevational view of the invention, illustrating vent trim panels of the invention trimming a vent feature of the building surface.
Figure 5:
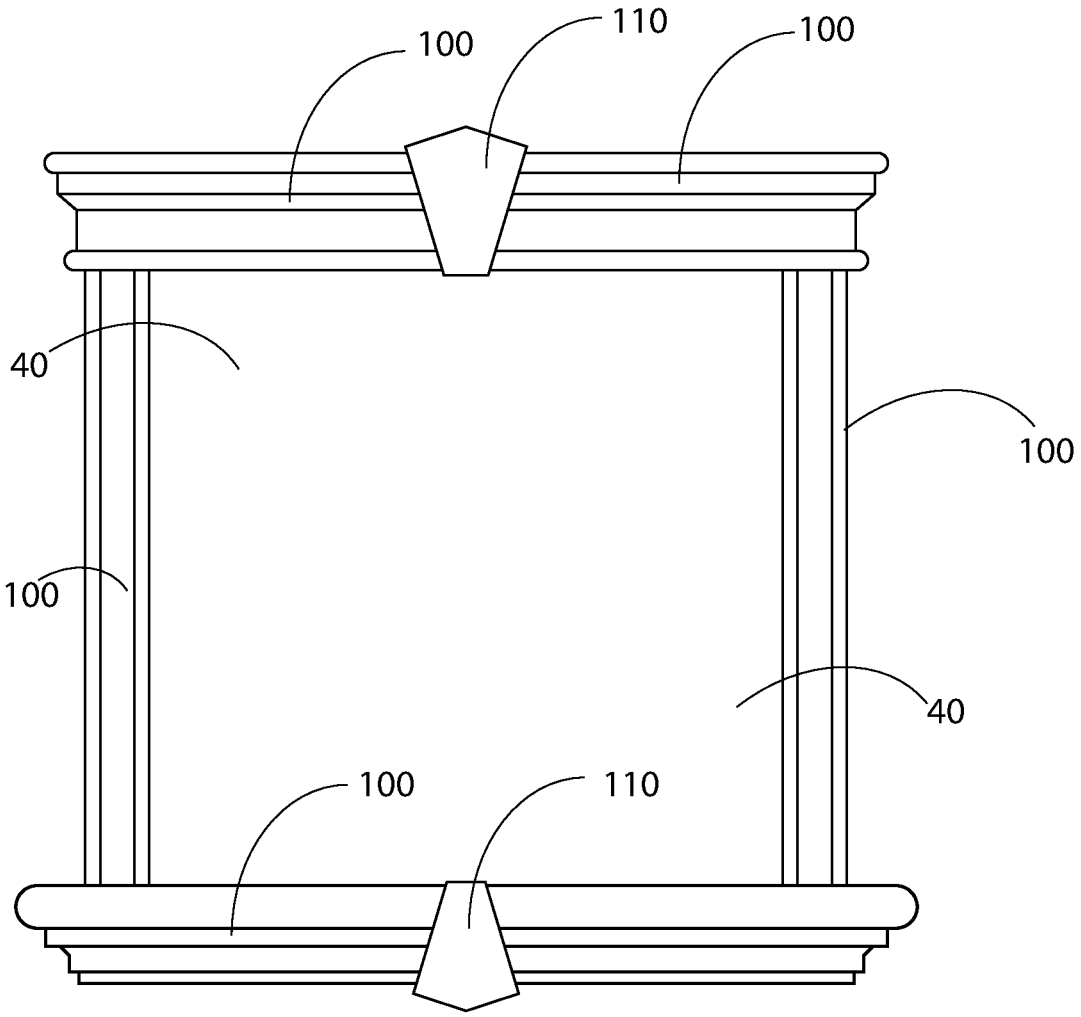
FIG. 5 is a front elevational view of the invention, illustrating a keystone cover option of the invention.

The bottom edge 49 of each building panel preferably has an interlocking fit 60 with the top edge 41 of another of the building panels 40. Similarly, the left edge 44 of each building panel 40 has an interlocking fit 60 with the right edge 46 of another of the building panels 40. As such, all of the building panels 40 hold each other together against the building surface 15 (FIG. 3). The interlocking fit 60 may be a tongue-in-groove type interlocking fit 60, for example, or other arrangement as is or becomes known in the art.

Some of the building panels 40 may include a hooked flange 70 (FIG. 1) projecting away from the front surface 42 proximate the bottom edge 49 thereof. A flange-receiving groove 75 projects away from the front surface 42 of such building panels 40 proximate the top edge 41 thereof. The flange-receiving groove 75 of adjacent building panels 40 cooperate with the hooked flange 70 of another of the building panels 40 to mutually secure the building panels 40 together. Preferably the flange-receiving groove 75 includes a forward surface 76 substantially parallel with the front surface 42 of each building panel 40 that can be decorated individually in a trim color, or the like, as desired. Building panels 40 with such a hooked flange 70 and/or flange-receiving groove 75 may or may not include the cleat depression 50, such panels 40 being held to the building surface 15 by each other and not necessarily one of the rigid cleats 30.

Some embodiments include a gable rail 80 fixed with the building surface 15 that projecting outwardly from the building surface 15. Corresponding building panels 40 further includes a gable rail-receiving slot 85 formed within the rear surface 48 thereof that is adapted to receive the gable rail 80 to hold the building panel 40 to the building surface 15. Such a gable rail 80 may include a J-shaped portion 90 at a distal end 88 thereof, such that when inserted into the gable rail-receiving slot 85 of the building panel, the J-shaped portion 90 flexes to catch or bind the gable rail-receiving slot 85 of the building panel 40 to inhibit removal thereof from the building surface 15.

Some of the building panels 40 take the form of a trim panel 100 that has an ornate front surface 108. The rear surface 48 of such trim panels 100 include one of the gable rail-receiving slots 85 formed therein for mounting with the gable rail 80 fixed with the building surface 15.

A keystone cover 110 (FIGS. 1 and 5) may be included that has a decorative front surface 118 and a rear side 108 shaped to engage the ornate front surface 108 of the trim panel 100 for fixing thereto with one of the mechanical fasteners 120, adhesive, or the like. The keystone cover 110 is preferably also coated with the building materials 20 and is made of expanded polystyrene.

Figure 1:
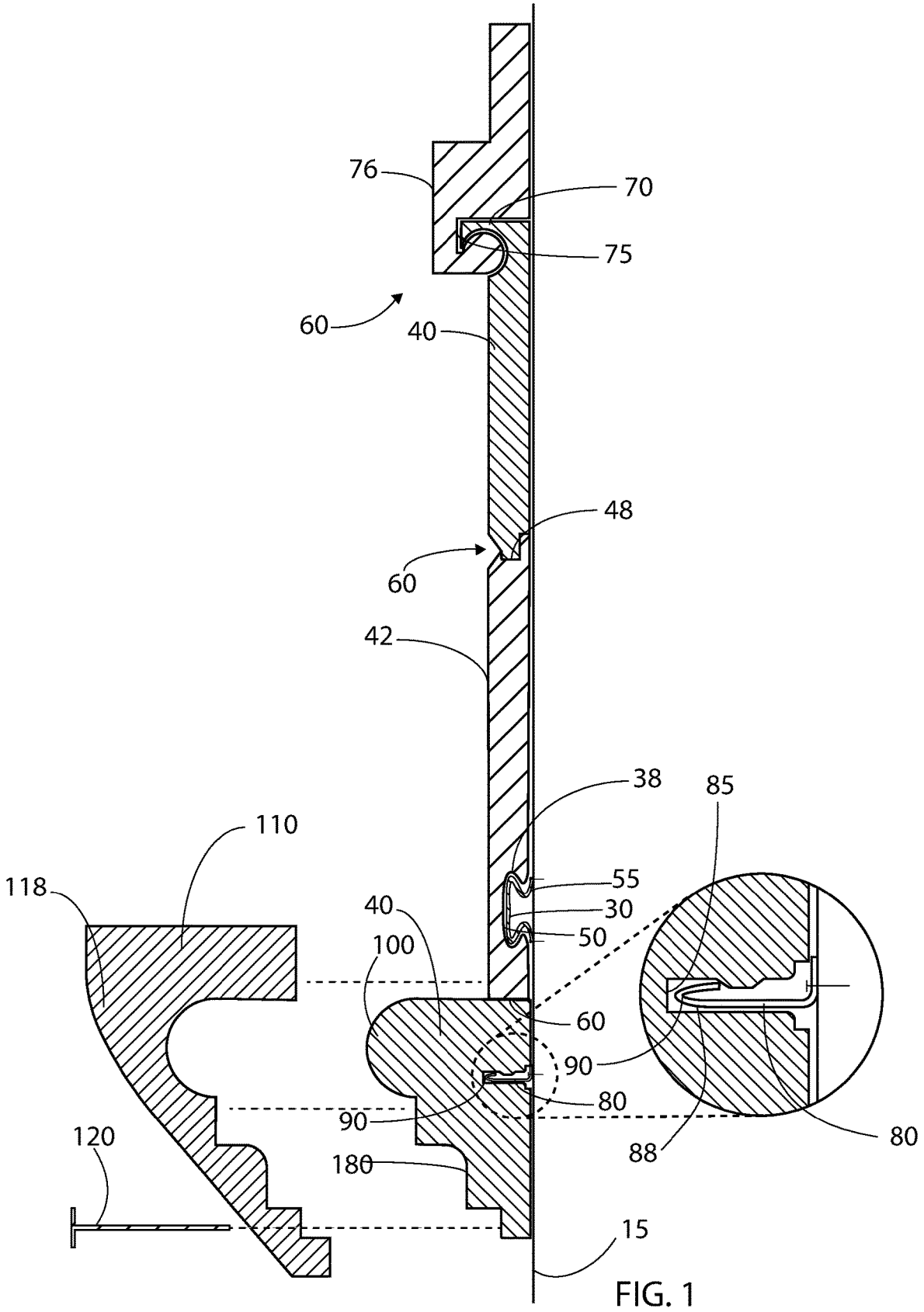
FIG. 1 is a side cross-sectional view of the invention, showing various building panels of the invention fixed with a building surface.
Figure 2:
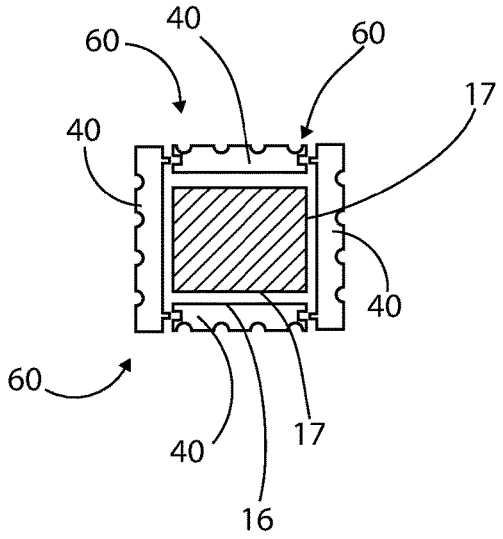
FIG. 2 is a top plan view of building panels of the invention that cooperate to cover four sides of a vertical column.

In cases where the building surface 15 is a vertical column 16 (FIG. 2), the left edge 44 of each building panel 40 has the interlocking fit 60 with the right edge 46 of another of the building panels 40 at an angle of 90-degrees, such that four of the building panels 40 are used to cover four sides 17 of the vertical column 16.

An address plaque panel 130 (FIG. 3) may be included that has a rear side adapted for fitting against the front surface 42 of one of the building panels 40. Such an address plaque panel 130 may be fixed with one of the building panels 40 with the mechanical fasteners 120, adhesive, or the like.

A plurality of vent trim panels 140 (FIG. 4) may be included that engage each other at an angle A greater than zero degrees, such that a vent structure 18 of the building surface 15 can be trimmed with the plurality of vent trim panels 140.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A panel mounting system for mounting building materials to a building surface, comprising:

a rigid cleat fixed with the building surface and having at least one extending lip;

a plurality of building panels each having a front surface, a rear surface, a top edge, a bottom edge, a left edge, and a right edge, each building panel having a cleat depression formed in the rear surface parallel to the bottom edge of thereof, the cleat depression having at least one cleat lip resiliently deforming and then extending over the cleat depression for engaging the at least one extending lip of the rigid cleat, each building panel when fully engaged with the rigid cleat held thereby against the building surface;

the bottom edge of each building panel having an interlocking fit with the top edge of another of the at least one building panels, and the left edge of each building panel having an interlocking fit with the right edge of another of the at least one building panels, to hold all of the at least one building panels against the building surface; and a gable rail fixed with the building surface and projecting outwardly away therefrom, the wherein each panel further including a gable rail-receiving slot formed within the rear surface thereof; whereby the panel is further held to the building surface when the gable rail-receiving slot receives therein the gable rail.

2. The panel mounting system of claim 1 wherein at least one building panel includes a hooked flange projecting away from the front surface proximate the bottom edge of thereof, and wherein another panel includes a flange-receiving groove projecting away from the front surface proximate the top edge thereof, the flange-receiving groove of adjacent building panels cooperative with the hooked flange of another of the at least one building panels to mutually secure the building panels together.

3. The panel mounting system of claim 2 wherein the flange-receiving groove includes a forward surface substantially parallel with the front surface of each building panel.

4. The panel mounting system of claim 1 wherein the gable rail includes a J-shaped portion at a distal end thereof, whereby the gable rail, when inserted into the gable rail-receiving slot of the panel, catches the panel to inhibit removal thereof with a binding force.

5. The panel mounting system of claim 1 wherein at least one of the at least one building panels takes the form of a trim panel having an ornate front surface, the rear surface thereof including a gable rail-receiving slot formed therein.

6. The panel mounting system of claim 5 further including a keystone cover having a decorative front surface, a rear side shaped to engage the ornate front surface of the trim panel for fixing thereto with a mechanical or adhesive fastener.

7. The panel mounting system of claim 1 wherein when the building surface is a vertical column, the left edge of each building panel has an interlocking fit with the right edge of another of the building panels at an angle of 90-degrees, whereby four of the building panels are used to cover four sides of the vertical column.

8. The panel mounting system of claim 1 further including an address plaque panel having a rear side adapted for fitting against the front surface of one of the building panels.

9. The panel mounting system of claim 1 wherein some of the plurality of building panels include a plurality of vent trim panels that engage other vent trim panels at an angle greater than zero degrees, whereby a vent feature in the building surface can be trimmed with the plurality of vent trim panels.

10. The panel mounting system of claim 1 wherein each building panel is made of expanded polystyrene.

11. The panel mounting system of claim 10 wherein each building panel is coated on at least the front side thereof with a building material taken from the group consisting of: sand, brick, rock, cement, plaster, stucco, vinyl, wood, bark, and plastic.

12. A panel mounting system for mounting building materials to a building surface, comprising:

a rigid cleat fixed with the building surface and having at least one extending lip;

a plurality of building panels each having a front surface, a rear surface, a top edge, a bottom edge, a left edge, and a right edge, each building panel having a cleat depression formed in the rear surface parallel to the bottom edge of thereof, the cleat depression having at least one cleat lip resiliently deforming and then extending over the cleat depression for engaging the at least one extending lip of the rigid cleat, each building panel when fully engaged with the rigid cleat held thereby against the building surface;

the bottom edge of each building panel having an interlocking fit with the top edge of another of the at least one building panels, and the left edge of each building panel having an interlocking fit with the right edge of another of the at least one building panels, to hold all of the at least one building panels against the building surface;

at least one building panel including a hooked flange projecting away from the front surface proximate the bottom edge of thereof, and another building panel including a flange-receiving groove projecting away from the front surface proximate the top edge thereof, the flange-receiving groove of adjacent building panels cooperative with the hooked flange of another of the at least one building panels to mutually secure the building panels together, the flange-receiving groove including a forward surface substantially parallel with the front surface of each building panel;

a gable rail fixed with the building surface and projecting outwardly away therefrom, each panel further including a gable rail-receiving slot formed within the rear surface thereof, the gable rail includes a J-shaped portion at a distal end thereof so that the gable rail catches the panel once inserted to inhibit removal thereof with a binding force;

at least one of the at least one building panels taking the form of a trim panel having an ornate front surface, the rear surface thereof including a gable rail-receiving slot formed therein;

a keystone cover having a decorative front surface including a rear side shaped to engage the ornate front surface of the trim panel for fixing thereto with a mechanical or adhesive fastener;

an address plaque panel having a rear side adapted for fitting against the front surface of one of the building panels;

a plurality of vent trim panels that engage each other vent trim panel at an angle greater than zero degrees, wherein a vent feature in the building surface can be trimmed with the plurality of vent trim panels;

each building panel being made from expanded polystyrene; and each building panel being coated on at least the front side thereof with a building material taken from the group consisting of: sand, brick, rock, cement, plaster, stucco, vinyl, wood, bark, and/or plastic;

each building panel being coated on at least the front side thereof with a building material taken from the group consisting of: sand, brick, rock, cement, plaster, stucco, vinyl, wood, bark, and/or plastic.

13. The panel mounting system of claim 12 wherein when the building surface is a vertical column, the left edge of each building panel has an interlocking fit with the right edge of another of the building panels at an angle of 90-degrees, whereby four of the building panels are used to cover four sides of the vertical column.

* * * * *